US011192370B2

(12) United States Patent
Shimizu et al.

(10) Patent No.: US 11,192,370 B2
(45) Date of Patent: Dec. 7, 2021

(54) LIQUID EJECTION HEAD

(71) Applicant: CANON KABUSHIKI KAISHA, Tokyo (JP)

(72) Inventors: Naoko Shimizu, Kawasaki (JP); Yosuke Takagi, Yokohama (JP); Shimpei Yoshikawa, Yokohama (JP); Hiroki Tajima, Yokohama (JP); Kyosuke Toda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/902,570

(22) Filed: Jun. 16, 2020

(65) Prior Publication Data

US 2020/0398566 A1 Dec. 24, 2020

(30) Foreign Application Priority Data

Jun. 19, 2019 (JP) ..... JP2019-113766

(51) Int. Cl.
*B41J 2/145* (2006.01)
*B41J 2/14* (2006.01)

(52) U.S. Cl.
CPC ..... *B41J 2/1433* (2013.01); *B41J 2/145* (2013.01)

(58) Field of Classification Search
CPC ..... B41J 2/145; B41J 2/1433
See application file for complete search history.

(56) References Cited

U.S. PATENT DOCUMENTS

2010/0026747 A1* 2/2010 Miyamoto ..... B41J 2/155 347/12
2011/0292122 A1* 12/2011 Anderson ..... B41J 2/155 347/43

FOREIGN PATENT DOCUMENTS

JP 2012-066568 A 4/2012

* cited by examiner

*Primary Examiner* — Lamson D Nguyen
(74) *Attorney, Agent, or Firm* — Canon U.S.A., Inc. IP Division

(57) ABSTRACT

A liquid ejection head includes a recording element substrate including a plurality of ejection port arrays, a support member supporting the recording element substrate, and including a plurality of liquid chambers, and a channel member including a plurality of channels. Each of the plurality of liquid chambers includes an opening connected to one of the plurality of channels. Each of the plurality of channels is a channel that extends upward from the opening in a vertical direction, in a posture of the liquid ejection head in ejecting the liquid. A volume of the channel connected to the opening located at a central portion of the liquid chamber in the longitudinal direction, among the plurality of channels, is greater than a volume of the channel connected to the opening located on an end portion side apart from the central portion of the liquid chamber in the longitudinal direction.

11 Claims, 8 Drawing Sheets

LIQUID EJECTION HEAD

BACKGROUND OF THE DISCLOSURE

Field of the Disclosure

The present disclosure relates to a liquid ejection head.

Description of the Related Art

In a liquid chamber of a support member supporting a recording element substrate that ejects liquid, bubbles can stagnate. When this stagnation occurs, for example, the bubbles can clog in the recording element substrate after travelling with the liquid flowing from the liquid chamber to the recording element substrate caused by liquid-ejection operation. This clog can reduce recording quality. Japanese Patent Application Laid-Open No. 2012-66568 discusses a configuration that can reduce stagnation of bubbles inside a liquid chamber of a support member during operation such as suction recovery. In this configuration, an opening of the liquid chamber of the support member is located near an end portion of the liquid chamber in a longitudinal direction thereof.

In a case where an arrangement of openings is limited for a reason, such as downsizing of a recording element substrate or a reduction in distance between ejection port arrays, it is difficult to arrange each of all the openings at an end portion of a liquid chamber of a support member, and thus bubbles can stagnate inside the liquid chamber.

SUMMARY OF THE DISCLOSURE

In view of such a situation, the present disclosure is directed to a liquid ejection head that suppresses stagnation of bubbles inside a liquid chamber of a support member, even in a case where an arrangement of openings is limited.

According to an aspect of the present disclosure, a liquid ejection head includes a recording element substrate including a plurality of ejection port arrays that ejects liquid, a support member supporting the recording element substrate, and including a plurality of liquid chambers that supplies the liquid to the plurality of ejection port arrays, and a channel member including a plurality of channels that supplies liquid to the plurality of liquid chambers of the support member. Each of the plurality of liquid chambers includes an opening connected to one of the plurality of channels. A longitudinal direction of each of the plurality of liquid chambers is a direction along an extending direction of the plurality of ejection port arrays. Each of the plurality of channels is a channel that extends upward from the opening in a vertical direction, in a posture of the liquid ejection head in ejecting the liquid. A volume of the channel connected to the opening located at a central portion of the liquid chamber in the longitudinal direction, among the plurality of channels, is greater than a volume of the channel connected to the opening located on an end portion side apart from the central portion of the liquid chamber in the longitudinal direction.

Further features and aspects of the present disclosure will become apparent from the following description of example embodiments with reference to the attached drawings.

DESCRIPTION OF THE EMBODIMENTS

First Example Embodiment

A first example embodiment of the present disclosure will be described below with reference to the drawings.

(Example Liquid Ejection Head)

Figure 1A:
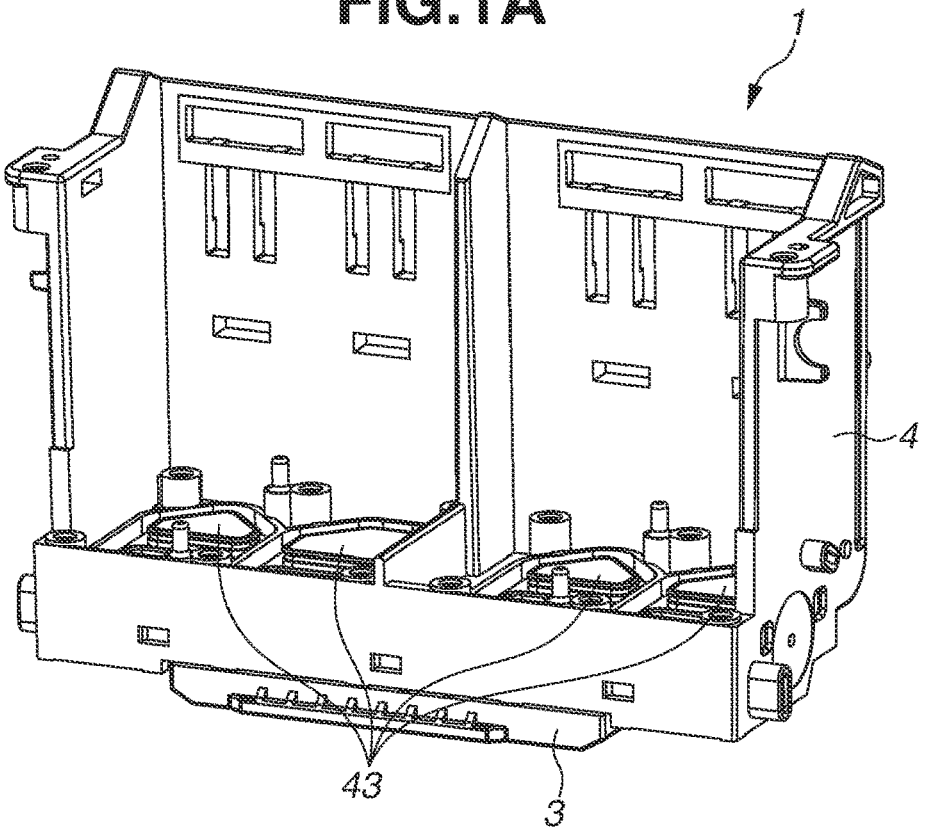
FIGS. 1A and 1B are perspective diagrams illustrating a liquid ejection head according to a first example embodiment.
Figure 1B:
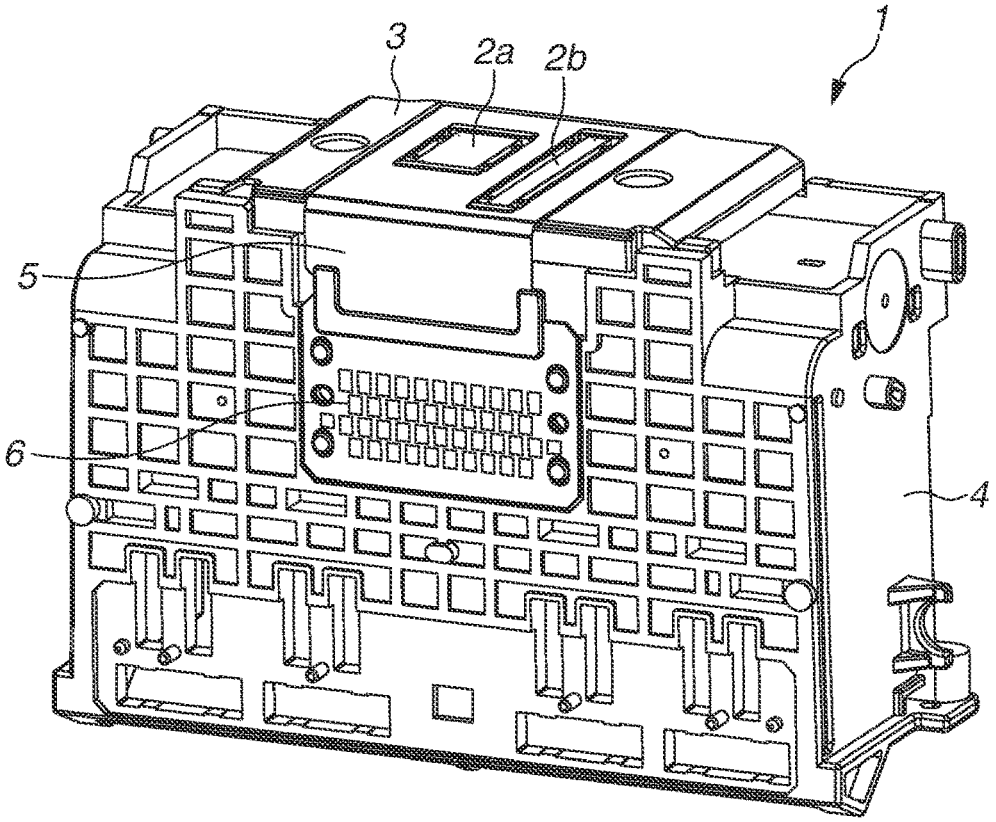
Figure 2:
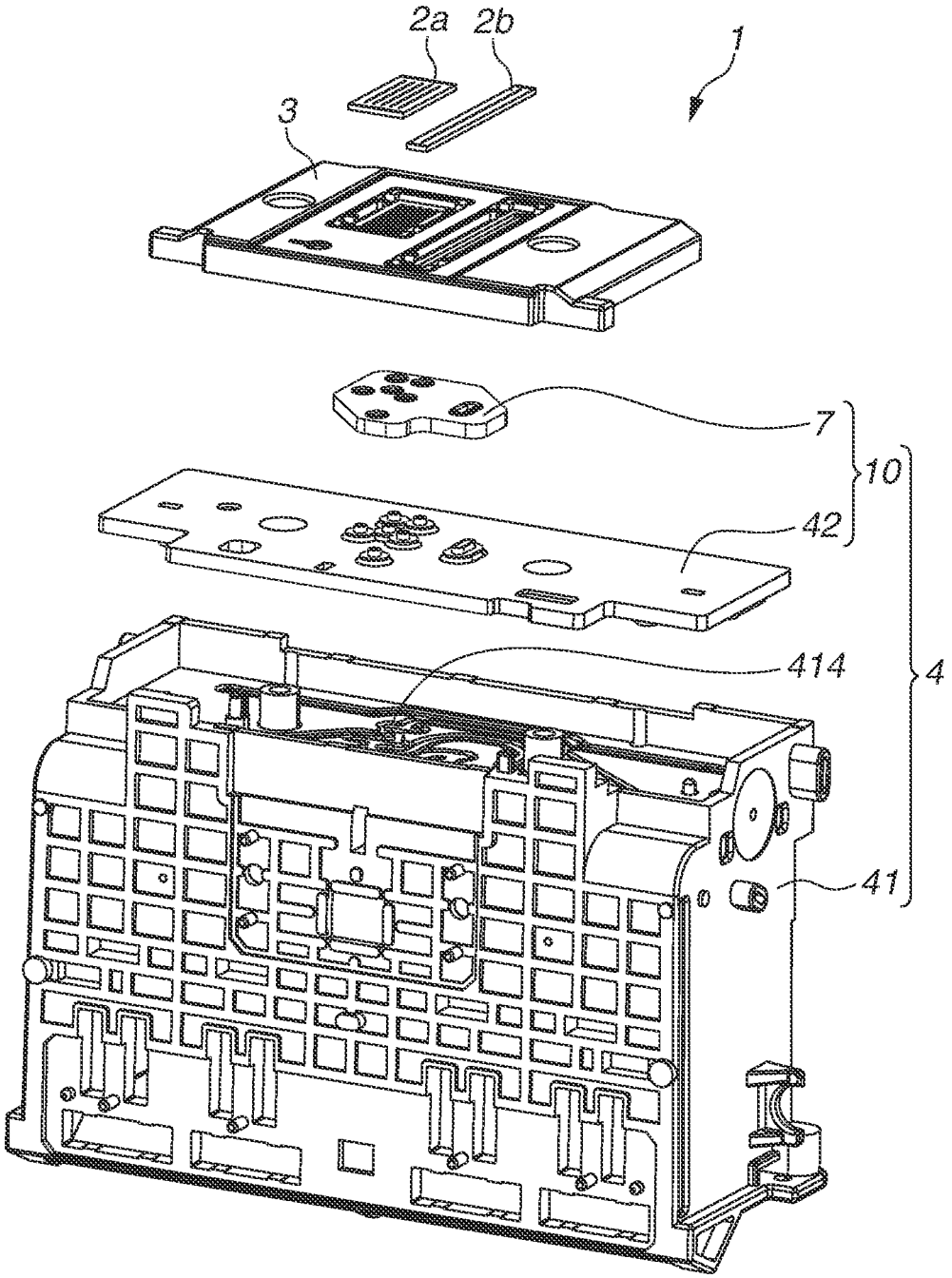
FIG. 2 is an exploded perspective diagram illustrating the liquid ejection head.

A liquid ejection head according to the present example embodiment will be described with reference to FIGS. 1A, 1B, and FIG. 2. FIGS. 1A and 1B are perspective diagrams illustrating a liquid ejection head 1 used in the present example embodiment. FIG. 2 is an exploded perspective diagram illustrating components of the liquid ejection head 1. These components are related to liquid supply. The liquid ejection head 1 is to be mounted on a carriage of a liquid ejection apparatus of serial-scan type. The liquid ejection head 1 may be a configuration to be disposed in a liquid ejection apparatus of full-line type.

The liquid ejection head 1 includes a recording element substrate 2 (specifically, two recording element substrates 2*a* and 2*b*), a support member 3, a housing 4, an electric wiring board 5, and an electric connection board 6. The housing 4 includes a main body member 41 and a channel member 10. The channel member 10 includes a seal member 7 and a channel component member 42. Liquid is supplied, from a liquid storage portion (not illustrated) connected to a joint portion 43 of the housing 4, to a liquid chamber 32 (FIGS. 4A and 4B) of the support member 3, through a horizontal channel 44 (FIG. 3B) and a vertical channel 45 (FIG. 3B) of the housing 4. The liquid is subsequently supplied to the recording element substrate 2. The liquid ejection apparatus (not illustrated) drives energy generating elements, such as a heater disposed on the recording element substrates 2*a* and 2*b*, via the electric connection board 6 and the electric wiring board 5, so that the liquid is ejected from an ejection port. The support member 3 is formed of, for example, aluminum oxide or resin. The support member 3 and the channel component member 42 may not be connected by the seal member 7, and may be connected by an adhesive agent, or may be directly connected by a process such as welding.

The horizontal channel 44 (FIG. 3B) is formed by combining a channel component portion 414 of the main body member 41 and a channel component portion 424 (FIGS. 4A and 4B) of the channel component member 42. Further, a channel 9 (FIGS. 4A and 4B) that supplies the liquid to the liquid chamber 32 (FIGS. 4A and 4B) of the support member 3 is formed by combining the channel component member 42 and the seal member 7. The channel 9 extends upward from an opening 31 (FIGS. 4A and 4B) of the liquid chamber 32 in a vertical direction. As described in detail below, the channel 9 includes the vertical channel 45 and a seal opening 71. Extending upward from the opening 31 of the liquid chamber 32 in the vertical direction means that a line that connects an end portion on the opening 31 side of the channel 9 and an end portion on an opposite side of the opening 31 of the channel 9 is at an angle within the range of ±20 degrees from the vertical direction. Thus, the channel 9 may have an axis inclined to some extent with respect to a line perpendicular to the opening 31 (FIGS. 4A and 4B) of the liquid chamber 32. The channel 9 may have non-uniform cross-sectional areas that vary depending on the position. As described in detail below, the channel 9 may be of any type if the channel 9 extends upward from the opening 31 in the vertical direction so that bubbles inside the liquid chamber 32 that have moved upward in the vertical direction can be held. The vertical direction is a direction in a posture of the liquid ejection head 1 when in use (when mounted on the liquid ejection apparatus).

(Example Vertical Channel Layout)

Figure 3A:
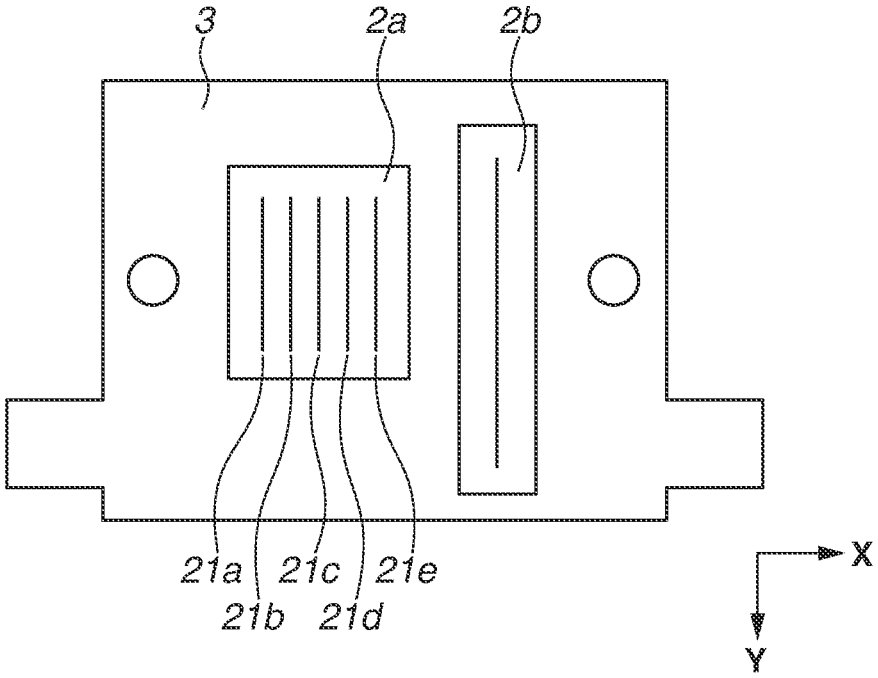
FIGS. 3A and 3B are schematic diagrams each illustrating an example arrangement of a recording element substrate, a support member, and a channel.
Figure 3B:
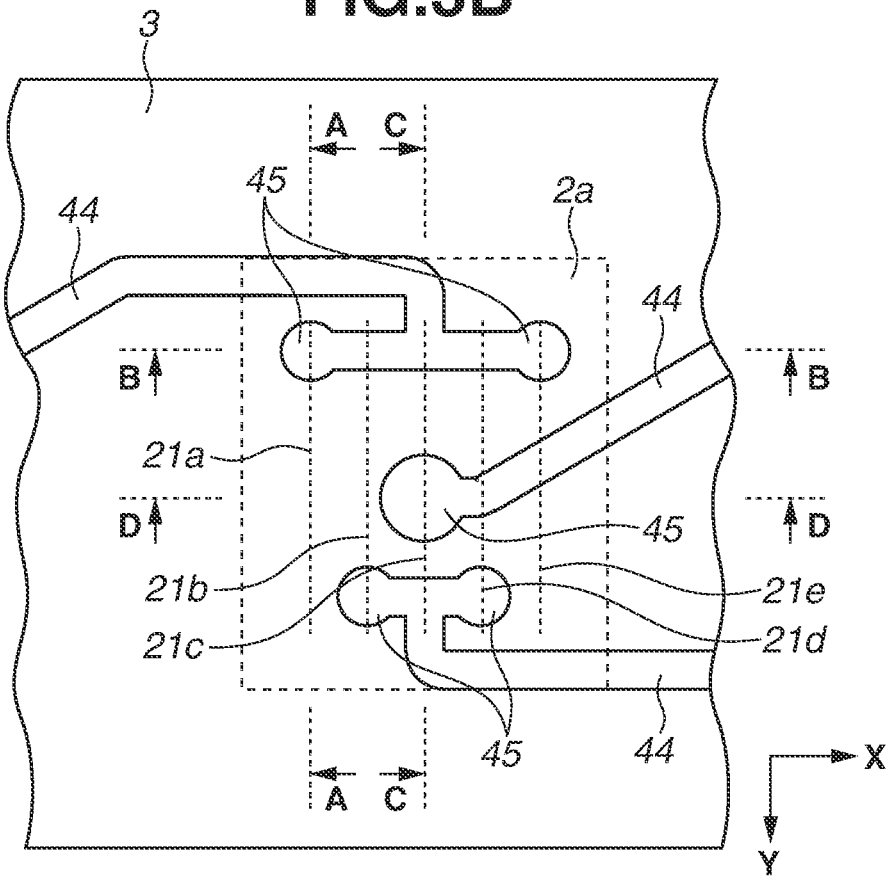

Layout of the vertical channel 45 that is a part of the channel 9 will be described with reference to FIGS. 3A and 3B. FIG. 3A is a diagram schematically illustrating the recording element substrate 2 and the support member 3. FIG. 3B is a schematic diagram illustrating an arrangement of the horizontal channel 44 and the vertical channel 45 in a vicinity of the recording element substrate 2*a*. As illustrated in FIGS. 3A and 3B, the recording element substrate 2*a* includes a plurality of ejection port arrays 21 (e.g., 21*a* to 21*e*). The ejection port arrays 21*a* and 21*e* and the ejection port arrays 21*b* and 21*d* are connected to respective common horizontal channels 44. The liquid flowing through the horizontal channel 44 is supplied to the liquid chamber 32 of the support member 3, through the vertical channel 45 connected to the horizontal channel 44. In FIGS. 3A and 3B, the same liquid (ink A) is supplied to the ejection port arrays 21*a* and 21*e*, and liquid (ink B) different from the liquid supplied to the ejection port arrays 21*a* and 21*e* is supplied to the ejection port arrays 21*b* and 21*d*. Another different liquid (ink C) is supplied to the ejection port array 21*c*. In other words, the ejection port arrays are symmetrically disposed in an order of the ink A, the ink B, the ink C, the ink B, and the ink A.

The opening 31 (FIGS. 4A and 4B) of the liquid chamber 32 is located at a position close to an end portion of the liquid chamber 32 in a longitudinal direction (Y-direction) of the ejection port arrays 21 (the liquid chambers 32). Thus, to be aligned with this location, the vertical channels 45 connected to the ejection port arrays 21*a*, 21*b*, 21*d*, and 21*e* are disposed at a position close to an end portion of these ejection port arrays 21. In other words, as will be described in detail below, the liquid chamber 32 located at each of both ends in an array direction (an X-direction) of the liquid chambers 32 has the opening 31 (FIGS. 4A and 4B) located at a position closer to the end portion of the liquid chamber 32 than a position of an opening 31 of an liquid chamber 32 located near a midsection in the array direction. The end portion of the liquid chamber 32 is a portion farthest from the center of the liquid chamber 32 in the longitudinal direction. In contrast, the vertical channel 45 connected to the ejection port array 21*c* is disposed at a position close to a center of the ejection port array 21*c*, because the opening 31 (FIGS. 5A and 5B) of the liquid chamber 32 is disposed at a position close to the center of the liquid chamber 32, in the longitudinal direction (the Y-direction) of the ejection port array 21 (the liquid chamber 32). Here, the center of the liquid chamber 32 is the center in the longitudinal direction of the liquid chamber 32.

The liquid chamber 32 having the opening 31 (FIGS. 5A and 5B) disposed at the position close to the center of the liquid chamber is illustrated in FIGS. 3A and 3B as the liquid chamber 32 located near the midsection in the array direction (the X-direction) of the liquid chambers 32. However, the present disclosure is not limited thereto. In other words, the liquid chamber located at an end in the array direction of the liquid chambers among the plurality of liquid chambers may have the opening disposed at a position close to the center of the liquid chamber.

In order to remove bubbles stagnating inside the liquid chamber 32 of the support member 3, it is desirable that the vertical channel 45 connected to the ejection port array 21*c* be also disposed at a position close to an end portion of the ejection port array 21*c*, as with the vertical channels 45 of the other ejection port arrays. However, it is difficult to dispose each of all the vertical channels 45 at a position close to an end portion of the ejection port array 21 for a reason such as downsizing of a recording element substrate. Thus, at least one of the vertical channels 45 is disposed closer to the center than the vertical channels 45 of the other ejection port arrays 21.

(Example Liquid Channel Path)

Figure 4A:
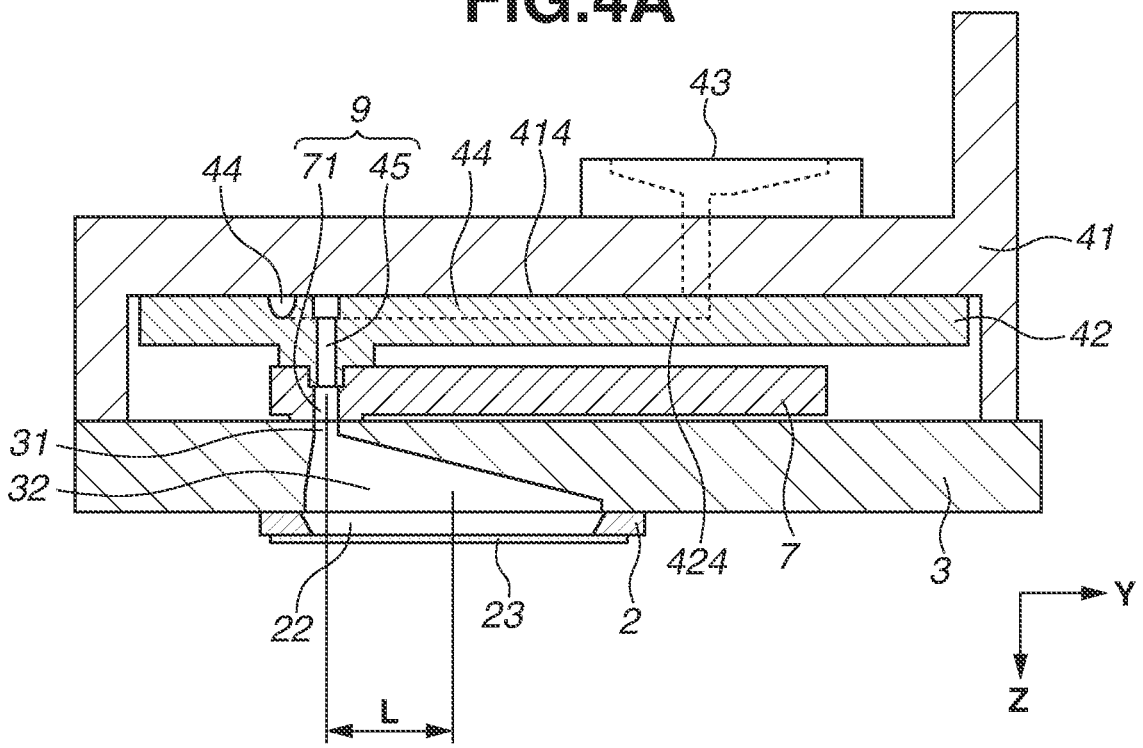
FIG. 4A is a diagram illustrating a cross section A-A taken from FIG. 3B.
Figure 4B:
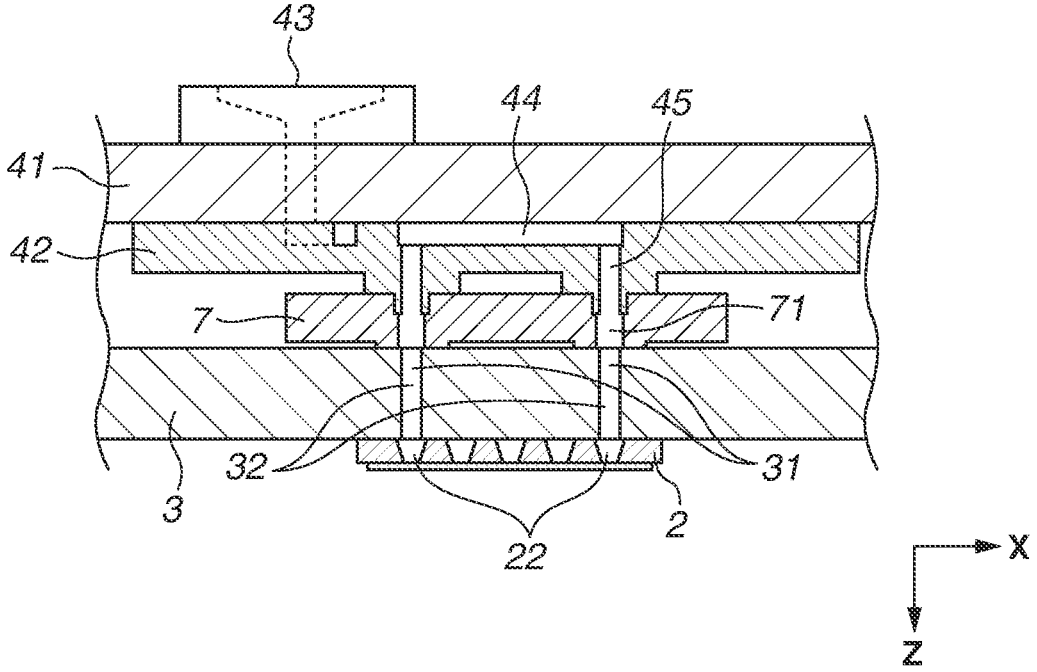
FIG. 4B is a diagram illustrating a cross section B-B taken from FIG. 3B.

The channel for the liquid from the joint portion 43 to the recording element substrate 2 will be described in detail with reference to FIGS. 4A and 4B. FIG. 4A is a schematic diagram illustrating a cross section A-A taken from FIG. 3B. FIG. 4B is a schematic diagram illustrating a cross section B-B taken from FIG. 3B. For the sake of the description, the cross-sectional diagram in each of FIGS. 4A and 4B illustrates only one channel, and the horizontal channel 44 is partly simplified. Liquid supplied from the joint portion 43 reaches the vertical channel 45 through the horizontal channel 44. The vertical channel 45 is connected to the seal opening 71 in the seal member 7, and the seal opening 71 connects to the opening 31 of the support member 3. After passing through the channel 9, the liquid flows through the opening 31 and the liquid chamber 32, and reached a common liquid chamber 22 of the recording element substrate 2. Subsequently, the liquid is supplied, from the common liquid chamber 22, to the individual channels (not illustrated) of the recording element substrate 2, and then ejected from an ejection port 23 (FIG. 4A) in response to driving of the energy generating element. The liquid chamber 32 of the support member 3 has a shape with an inclined surface such that a width in the Y-direction gradually increases from the opening 31 toward the recording element substrate 2.

(Relationship between Liquid Chamber and Each of Opening and Channel)

Figure 5A:
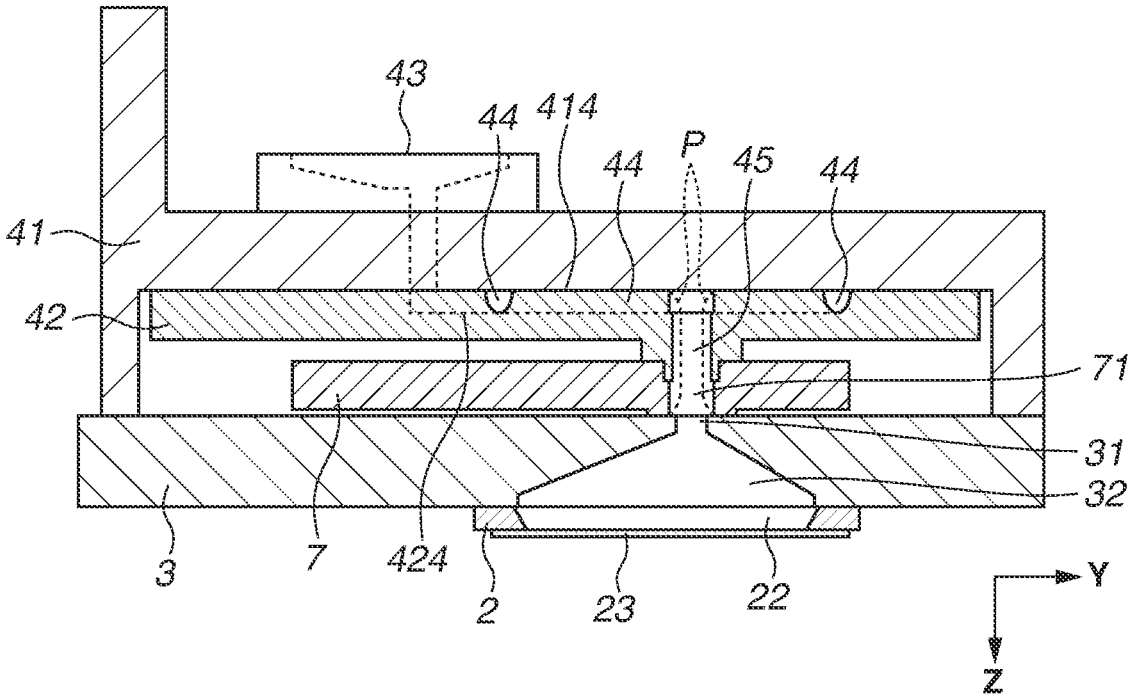
FIG. 5A is a diagram illustrating a cross section C-C taken from FIG. 3B.
Figure 5B:
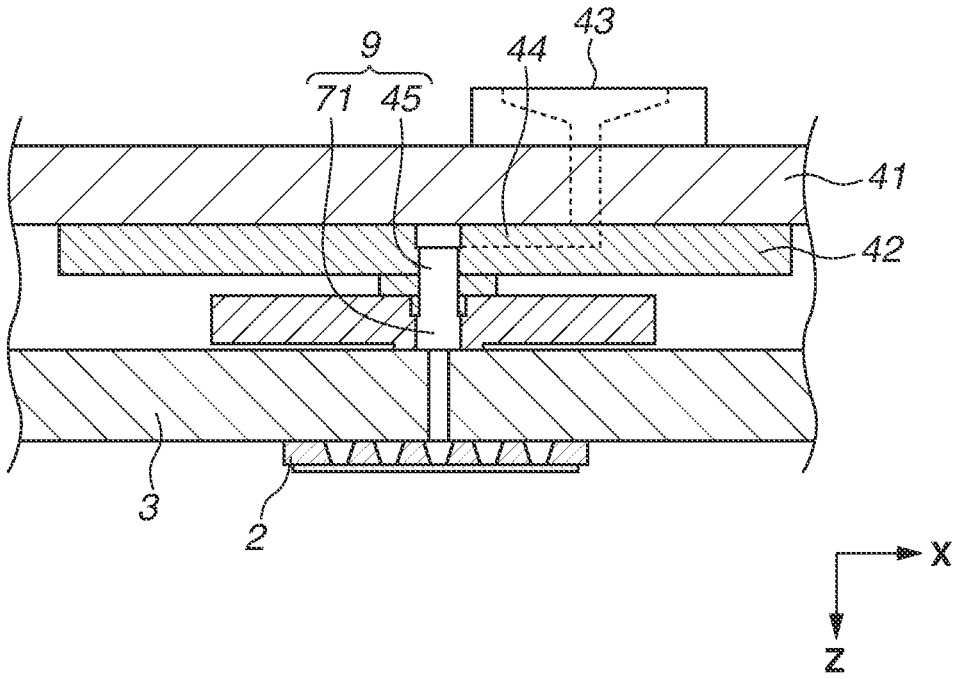
FIG. 5B is a diagram illustrating a cross section D-D taken from FIG. 3B.
Figure 6A:
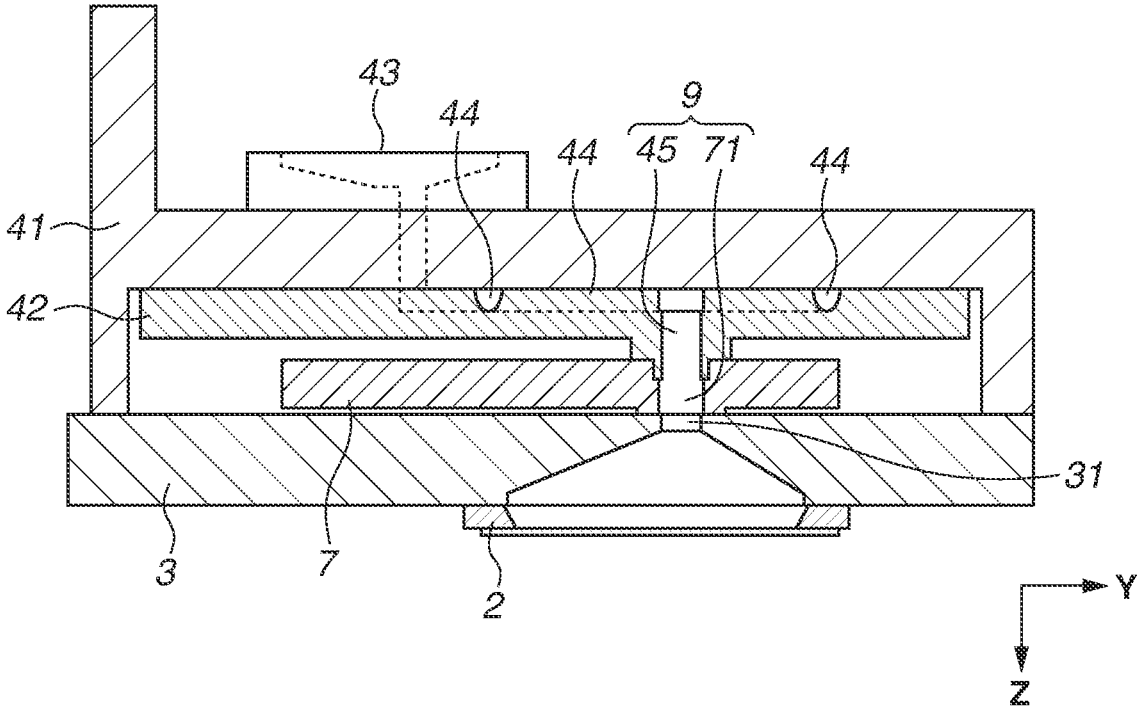
FIG. 6A is a diagram illustrating a cross section C-C taken from FIG. 3B.
Figure 6B:
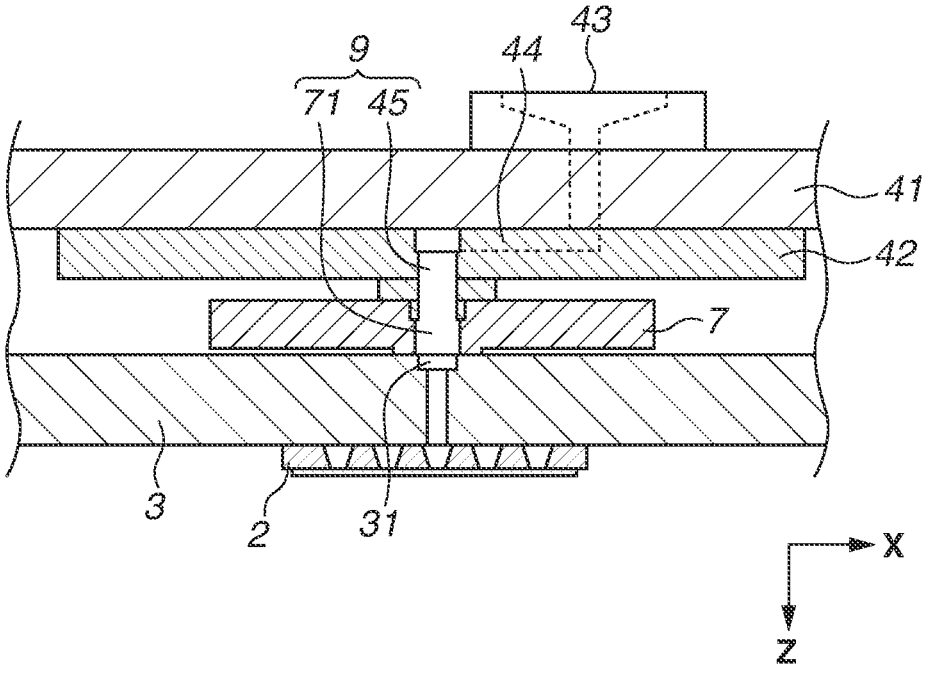
FIG. 6B is a diagram illustrating a cross section D-D taken from FIG. 3B.

A relationship between the liquid chamber 32 of the support member 3, which is a characteristic part of the present disclosure, and each of the opening 31 and the channel 9 will be described with reference to FIGS. 4A, 4B, 5A, 5B, 6A, and 6B. FIG. 5A is a schematic diagram illustrating a cross section C-C taken from FIG. 3B. FIG. 5B is a schematic diagram illustrating a cross section D-D taken from FIG. 3B. FIG. 6A is a schematic diagram illustrating a cross section C-C taken from FIG. 3B, according to a modification of the present example embodiment, in which an area of the opening 31 is larger than an area of the opening 31 illustrated in FIGS. 5A and 5B. FIG. 6B is a schematic diagram illustrating a cross section D-D taken from FIG. 3B, according to the modification of the present example embodiment, in which an area of the opening 31 is larger than an area of the opening 31 illustrated in FIGS. 5A and 5B. For the sake of the description, the horizontal channel 44 illustrated in each of FIGS. 5A, 5B, 6A, and 6B is partly simplified.

In the present disclosure, some liquid chambers 32 (liquid chambers 32 corresponding to the ejection port arrays 21*a*, 21*b*, 21*d*, and 21*e*) out of the plurality of liquid chambers each have an opening disposed at a position close to the end portion of the liquid chamber 32 in the Y-direction, as illustrated in FIGS. 4A and 4B. Further, a liquid chamber 32 different from the liquid chamber 32 illustrated in FIGS. 4A and 4B, which corresponds to the ejection port array 21*c*, has an opening 31 located at a position closer to the center of the liquid chamber 32 than the openings 31 the above-described liquid chambers 32 have, in the Y-direction, as illustrated in FIGS. 5A, 5B, 6A, and 6B.

When the opening 31 is located at the position close to the end portion of the liquid chamber 32, the liquid flows more closely to a ceiling portion (the inclined surface), toward the end portion opposite to the end portion where the opening 31 is located. Thus, a liquid backflow that occurs near the ceiling portion (the inclined surface) of the liquid chamber 32 can be suppressed. This suppresses stagnation of bubbles inside the liquid chamber 32 having the opening 31 at the position close to the end portion. Meanwhile, in the liquid chamber 32 having the opening 31 at the position close to the center, the liquid flows backward near the ceiling portion of the liquid chamber 32, so that bubbles tend to stagnate near the ceiling portion. In the present disclosure, in order to suppress the stagnation of bubbles even in such a liquid chamber, the cross-sectional area of the channel 9 connected to the opening 31 located at the position close to the center is larger than the cross-sectional area of the channel 9 connected to the opening 31 located at the position close to the end portion. The cross-sectional area is a cross-sectional area in a plane perpendicular to the extending direction (a Z-direction) of the channel 9, and this is an average value of the cross-sectional areas at randomly selected three locations.

The bubbles generated inside the liquid chamber 32 gradually move upward (in a direction opposite to the Z-direction) in the vertical direction with the passage of time. In this movement, in a case where an upper space (a volume of the opening 31 or the channel 9 connected to the opening 31) of the liquid chamber 32 is small, only some of the bubbles inside the liquid chamber 32 can move upward, and the rest of the bubbles remains in the liquid chamber 32 without being contained in the upper space. Thus, the volume of the channel 9 is increased by enlarging the cross-sectional area of the channel 9, so that a sufficient upper space (a portion P illustrated in FIG. 5A) of the liquid chamber 32 can be secured. When the upper space of the liquid chamber 32 is sufficient, many of the bubbles generated inside the liquid chamber 32 can be held outside the liquid chamber 32, so that the stagnation of the bubbles inside the liquid chamber 32 can be suppressed.

The flow velocity of the liquid flowing through the channel 9 can be reduced by increasing the cross-sectional area of the channel 9. This can inhibit the bubbles held in the P portion from returning to the inside of the liquid chamber 32 by traveling with the flow of the liquid. Further, the flow velocity of the liquid flowing through the opening 31 during recording can be reduced by increasing the cross-sectional area of the opening 31 in addition to increasing the cross-sectional area of the channel 9, as illustrated in FIGS. 6A and 6B. Reducing the flow velocity of the liquid flowing through the opening 31 can further inhibit the bubbles from returning to the inside of the liquid chamber 32 by traveling with the flow of the liquid. This can further suppress the stagnation of the bubbles remained inside the liquid chamber 32, and thus it is also more desirable to increase the cross-sectional area of the opening 31.

In order to suppress the stagnation of the bubbles, it is desirable that the cross-sectional area (volume) of the channel 9 connected to the opening 31 located at the position close to the center be 1.2 times or more the cross-sectional area (volume) of the channel 9 connected to the opening 31 located at the position close to the end portion. To suppress the stagnation of the bubbles, it is desirable to further increase the cross-sectional area (volume). The cross-sectional area (volume) is desirably 1.5 times or more, and more desirably, 2.0 times or more. However, if the cross-sectional area (volume) is excessively increased, the channel 9 can interfere with an adjacent liquid chamber 32, and this makes it difficult to dispose the channel 9 at an appropriate position in the support member 3. Thus, the cross-sectional area (volume) of the channel 9 connected to the opening 31 located at the position close to the center is desirably 5.0 times or less the cross-sectional area (volume) of the channel 9 connected to the opening 31 located at the position close to the end portion.

It is also possible to reduce the influence of the stagnation of the bubbles for the liquid chambers 32 corresponding to all the ejection port arrays 21 by increasing the cross-sectional area of each of the opening 31 and the channel 9, as with the liquid chamber 32 corresponding to the ejection port array 21*c*. However, in practice, it is often difficult to increase the cross-sectional areas of all the liquid chambers 32 due to layout limits. The configuration of the present disclosure is effective as a way of implementing a liquid ejection head that suppresses stagnation of bubbles in a limited space.

The liquid chambers 32 illustrated in FIGS. 4A, 4B, 5A, 5B, 6A, and 6B have a triangular shape. This is because it is more desirable that the liquid chamber 32 have such a slope that the width of the liquid chamber increases from the opening 31 toward the recording element substrate 2, in order to move the bubbles inside the liquid chamber 32 using the channel 9. In other words, a triangular liquid chamber is illustrated as an example of a liquid chamber having a slope. The influence of a wall that blocks upward movement of the bubbles in the vertical direction is reduced by taking the triangular shape for the liquid chamber.

In summary, the volume of the channel, among the plurality of channels, connected to the opening located at the central portion of the liquid chamber in the longitudinal direction is greater than the volume of the channel connected to the opening located on the end portion side of the liquid chamber in the longitudinal direction. Here, the end portion of the liquid chamber in the longitudinal direction is a region corresponding to one-third of the full length of the liquid chamber from each of both ends of the liquid chamber, and the central portion of the liquid chamber in the longitudinal direction is a rest of the region.

Second Example Embodiment

Figure 7:
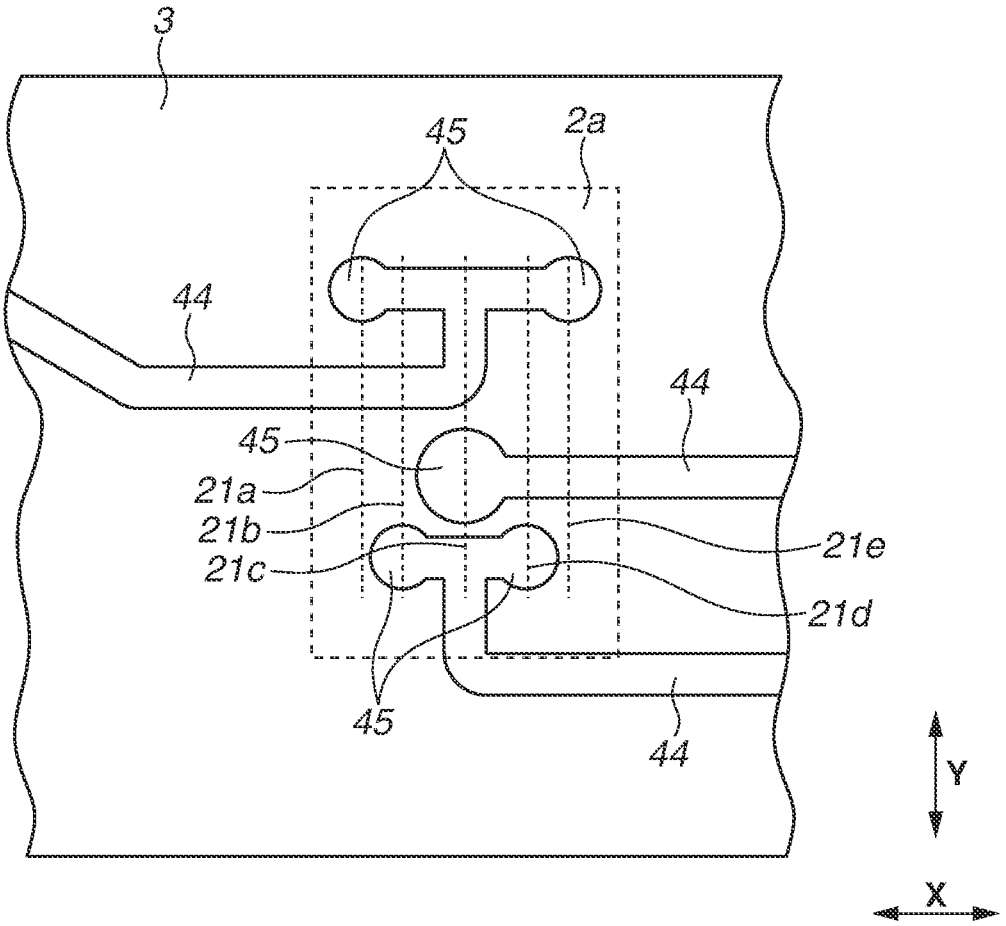
FIG. 7 is a schematic diagram illustrating an example ejection port array according to a second example embodiment.

A second example embodiment of the present disclosure will be described with reference to FIG. 7. Portions similar to those of the first example embodiment are provided with the same reference numerals as those of the first example embodiment and will not be described. FIG. 7 is a schematic diagram illustrating an arrangement of a horizontal channel 44 and a vertical channel 45, in a vicinity of a recording element substrate 2*a*, according to the present example embodiment. A characteristic part of the present example embodiment is to make an arrangement distance between ejection port arrays 21*c* and 21*b* and an arrangement distance between ejection port arrays 21*c* and 21*d* longer than other arrangement distances between ejection port arrays, as illustrated in FIG. 7. To match with the arrangement distances between the ejection port arrays 21, arrangement distances between the corresponding liquid chambers 32 of a support member also vary. In other words, the arrangement distance between the liquid chamber 32 corresponding to the ejection port array 21*c* located in the midsection in an X-direction and the liquid chamber 32 adjacent thereto is longer than the arrangement distance between the liquid chamber 32 corresponding to either one of the ejection port arrays 21*a* and 21*e* located at both ends and the liquid chamber 32 adjacent to the one. Here, the width of each of the liquid chambers 32 in the X-direction is not increased even though the arrangement distance between the liquid chambers 32 is varied, i.e., this width is equal to the width in the X-direction of each of the liquid chambers 32 according to the first example embodiment.

If the cross-sectional area of a channel 9 near the center of the liquid chamber 32 is increased, the channel 9 can interfere with an adjacent liquid chamber 32 depending on the arrangement distance between the liquid chambers 32. Thus, this makes it difficult to dispose the channel 9 at an appropriate position in the support member. Therefore, in the present example embodiment, stagnation of bubbles inside the liquid chamber 32 as well as mixture of liquids can be suppressed by adjusting the arrangement distance between the liquid chambers 32 according to the size of the channel 9, so that reduction in recording quality can be suppressed.

Example Third Embodiment

Figure 8A:
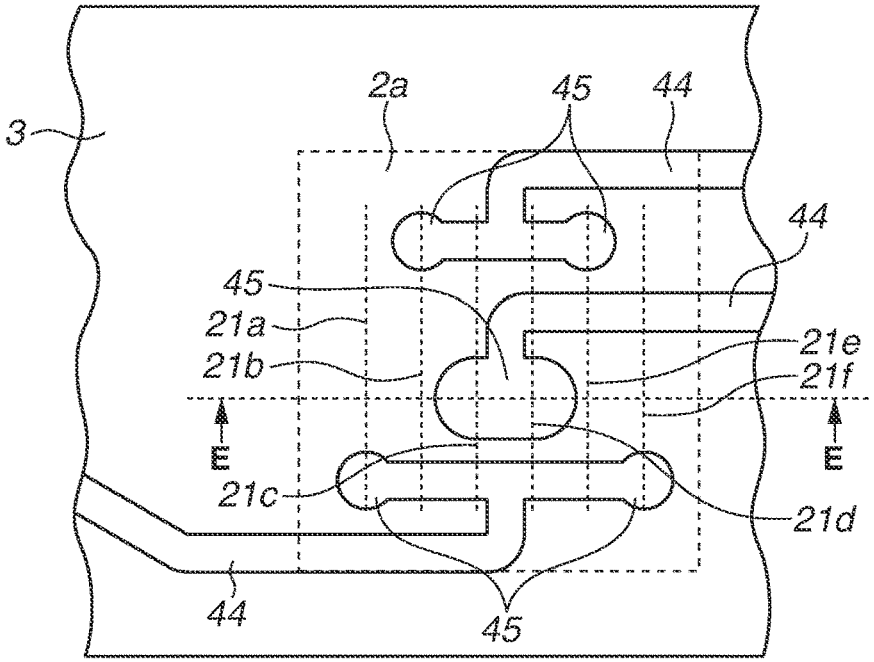
FIGS. 8A, 8B, and 8C are schematic diagrams each illustrating an example arrangement of a recording element substrate, a liquid chamber, and a channel according to a third example embodiment.
Figure 8B:
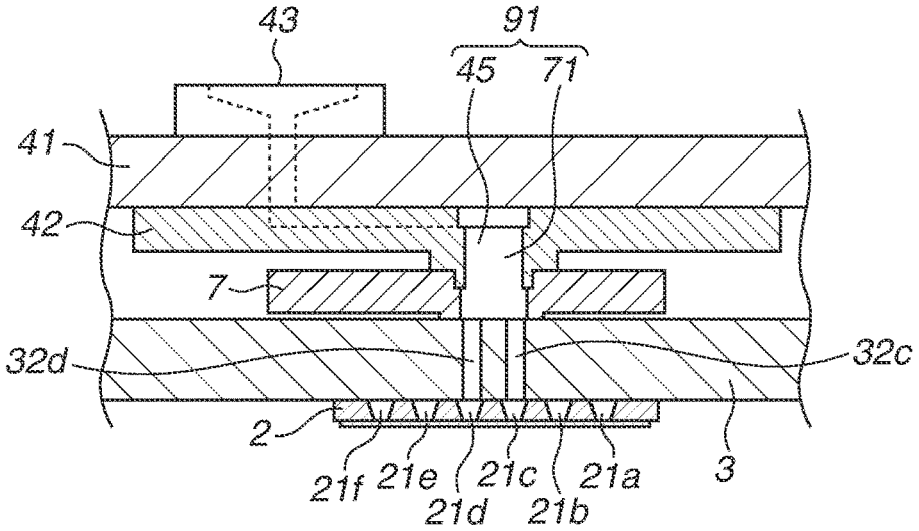
Figure 8C:
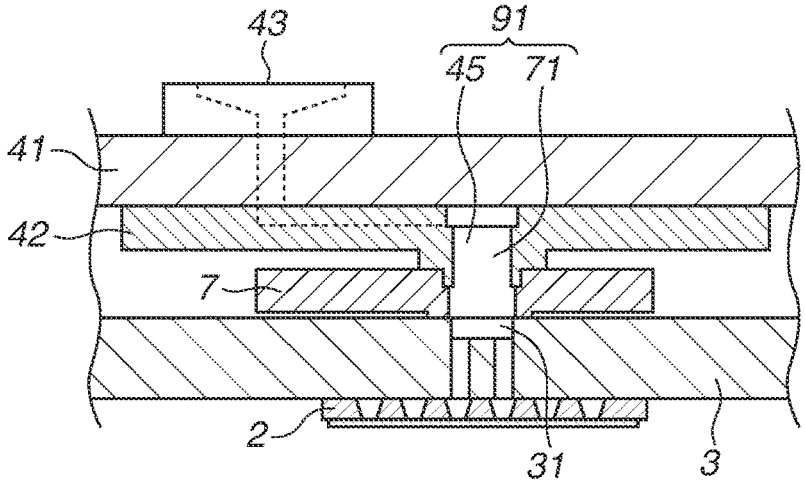

A third example embodiment of the present disclosure will be described with reference to FIGS. 8A to 8C. Portions similar to those of the first example embodiment are provided with the same reference numerals as those of the first example embodiment and will not be described. FIG. 8A is a schematic diagram illustrating an arrangement of a horizontal channel 44 and a vertical channel 45, in a vicinity of a recording element substrate 2*a*, according to the present example embodiment. FIG. 8B is a schematic diagram illustrating a cross section E-E taken from FIG. 8A. FIG. 8C is a schematic diagram illustrating a modification thereof. For the sake of the description, the horizontal channel 44 illustrated in FIGS. 8A to 8C is partly simplified. A characteristic part of the present example embodiment is that one channel 91 is connected to two liquid chambers 32*c* and 32*d* corresponding to ejection port arrays 21*c* and 21*d*, as illustrated in FIGS. 8A to 8C. Here, the two liquid chambers 32*c* and 32*d* connected to the one channel 91 are supplied with the same liquid, and thereby the channel 91 can be a common channel connected to the two liquid chambers 32*c* and 32*d*.

Further increasing the cross-sectional area of the channel 91 is effective in further suppressing stagnation of bubbles inside the liquid chamber 32. However, it can be difficult to further increase the cross-sectional area of the channel 91, because the channel 91 can interfere with the adjacent liquid chamber depending on the arrangement distance between the liquid chambers 32 if the cross-sectional area of the channel 91 is further increased. Even in such a case, the cross-sectional area of the channel 91 can be further increased by providing the two channels connectable to the two liquid chambers 32 as the one channel 91, so that the stagnation of bubbles can be further suppressed.

In each of the above-described example embodiments, the triangular liquid chamber is described. Specifically, the width of the liquid chamber 32 in the Y-direction gradually increases from the opening 31 toward the recording element substrate 2. However, the shape of the liquid chamber of the present disclosure is not limited to this shape. In other words, the shape of the liquid chamber may be a rectangle when the liquid chamber is viewed from a cross section C-C taken from FIG. 3B. It is possible to suppress the stagnation of the bubbles inside the liquid chamber 32 by increasing the cross-sectional area of the channel 9 connected to the opening 31, even in a case of the rectangular liquid chamber.

According to the present disclosure, stagnation of bubbles inside a liquid chamber of a support member can be suppressed, even in a case where an arrangement of openings is limited.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Application No. 2019-113766, filed Jun. 19, 2019, which is hereby incorporated by reference herein in its entirety.

What is claimed is:

1. A liquid ejection head comprising:

a recording element substrate including a plurality of ejection port arrays that ejects liquid;

a support member supporting the recording element substrate, and including a plurality of liquid chambers that supplies the liquid to the plurality of ejection port arrays; and a channel member including a plurality of channels that supplies liquid to the plurality of liquid chambers of the support member, wherein each of the plurality of liquid chambers includes an opening connected to one of the plurality of channels, wherein a longitudinal direction of each of the plurality of liquid chambers is a direction along an extending direction of the plurality of ejection port arrays, wherein each of the plurality of channels is a channel that extends upward from the opening in a vertical direction, in a posture of the liquid ejection head in ejecting the liquid, and wherein a volume of the channel connected to the opening located at a central portion of the liquid chamber in the longitudinal direction, among the plurality of channels, is greater than a volume of the channel connected to the opening located on an end portion side apart from the central portion of the liquid chamber in the longitudinal direction.

2. The liquid ejection head according to claim 1, wherein the volume of the channel connected to the opening located at the central portion is 1.2 times or more the volume of the channel connected to the opening located on the end portion side.

3. The liquid ejection head according to claim 1, wherein the volume of the channel connected to the opening located at the central portion is 1.5 times or more the volume of the channel connected to the opening located on the end portion side.

4. The liquid ejection head according to claim 1, wherein the volume of the channel connected to the opening located at the central portion is 2.0 times or more the volume of the channel connected to the opening located on the end portion side.

5. The liquid ejection head according to claim 1, wherein the volume of the channel connected to the opening located at the central portion is 5.0 times or less the volume of the channel connected to the opening located on the end portion side.

6. The liquid ejection head according to claim 1, wherein a cross-sectional area of the opening located at the central portion is larger than a cross-sectional area of the opening located on the end portion side.

7. The liquid ejection head according to claim 1, wherein a width of the liquid chamber in the longitudinal direction gradually increases from the opening toward the recording element substrate.

8. The liquid ejection head according to claim 7, wherein the liquid ejection head includes a single opening or a single channel connected to two liquid chambers adjacent to each other, the single opening being included in the plurality of liquid chambers, the single channel being one of the channels.

9. The liquid ejection head according to claim 1, wherein the liquid chamber including the opening located at the central portion is located in a midsection in an array direction of the plurality of liquid chambers.

10. The liquid ejection head according to claim 1, wherein an arrangement distance between the liquid chamber including the opening located at the central portion and the liquid chamber adjacent thereto is longer than an arrangement distance between the liquid chambers each having the opening located on the end portion side.

11. The liquid ejection head according to claim 1, wherein the channel member includes a seal member connected to the opening of the liquid chamber, and a channel component member connected to the seal member.

* * * * *